US011091233B2

(12) United States Patent
Suchomel

(10) Patent No.: US 11,091,233 B2
(45) Date of Patent: Aug. 17, 2021

(54) FIN ARRANGEMENT AND WATER SPORTS APPARATUS

(71) Applicant: FIREFIN GMBH, Vienna (AT)

(72) Inventor: Sergio Suchomel, Vienna (AT)

(73) Assignee: FIREFIN GMBH, Vienna (AT)

( * ) Notice: Subject to any disclaimer, the term of this patent is extended or adjusted under 35 U.S.C. 154(b) by 67 days.

(21) Appl. No.: 16/313,127

(22) PCT Filed: Jun. 23, 2017

(86) PCT No.: PCT/EP2017/065491

§ 371 (c)(1),
(2) Date: Dec. 24, 2018

(87) PCT Pub. No.: WO2017/220762

PCT Pub. Date: Dec. 28, 2017

(65) Prior Publication Data

US 2019/0225308 A1 Jul. 25, 2019

(30) Foreign Application Priority Data

Jun. 24, 2016 (AT) ..... A 50573/2016

(51) Int. Cl.
*B63B 32/66* (2020.01)
*B63B 32/57* (2020.01)

(52) U.S. Cl.
CPC ..... *B63B 32/66* (2020.02); *B63B 32/57* (2020.02)

(58) Field of Classification Search
CPC ..... B63B 1/24; B63B 1/242; B63B 1/244; B63B 1/246; B63B 1/248; B63B 32/60; B63B 32/66; B63B 34/40; B63B 34/45
See application file for complete search history.

(56) References Cited

U.S. PATENT DOCUMENTS 6,991,504 B1 * 1/2006 English ..... B63B 32/66 441/79
2005/0287888 A1 12/2005 Balester
2016/0144933 A1 5/2016 Kumano
2017/0073047 A1 * 3/2017 Miller ..... B63B 32/66
2018/0251197 A1 * 9/2018 Miller ..... B63B 32/60

FOREIGN PATENT DOCUMENTS

DE 3307412 A1 9/1984
WO 2009/142479 A1 11/2009
WO 2014/008529 A1 1/2014
WO WO2015/135034 A1 9/2015
WO WO2015/172199 A1 11/2015

OTHER PUBLICATIONS

International Search Report of Application No. PCT/EP2017/065491 dated Sep. 15, 2017.
Written Opinion of Application No. PCT/EP2017/065491 dated Sep. 15, 2017.

* cited by examiner

*Primary Examiner* — Andrew Polay
(74) *Attorney, Agent, or Firm* — Gordon & Jacobson, P.C.

(57) ABSTRACT

Fin arrangement for a water sports device, having a base body (1) and a fin (3) which is detachably connected or connectable to the base body (1) via a spring element (2), whereby the base body (1) has a mounting surface (21) for resting against the sliding surface (5) of the main body (4) of the water sports device, and whereby the fin (3) has a recess (24) for receiving at least part of the base body (1). The fin arrangement may be arranged on the sliding surface (5) of the main body (4) of a water sports device.

19 Claims, 13 Drawing Sheets

FIN ARRANGEMENT AND WATER SPORTS APPARATUS

CROSS-REFERENCE TO RELATED APPLICATION(S)

This application is the National Stage of International Patent Application No. PCT/EP2017/065491 filed on Jun. 23, 2017, which claims priority from Austrian Patent Application No. AT A50573/2016 filed on Jun. 24, 2016, both of which are herein incorporated by reference herein in their entireties.

BACKGROUND

1. Field

The present disclosure relates to a fin arrangement as well as a water sports device.

2. State of the Art

Fin arrangements for the formation of a fin on a water sports device are known and published in different versions. Fins are basically guiding elements which are provided on the sliding surfaces of water sports devices such as surfboards, wakeboards, kiteboards or similar sports devices in order to facilitate the control and, if necessary, the steering of the sports devices.

With conventional water sports devices, the fins are usually inseparably connected to the main body of the water sports device and in particular glued to it or bonded to it via laminate layers. The disadvantage of these fixed connections is that the fin size cannot be adapted to different conditions. Furthermore, in practice, the problem arises that a defective fin cannot simply be replaced.

For this reason, systems are known in which replaceable fins can be connected to the main body of the water sports device via screw connections. For this purpose, a solid holding body with externally located openings is laminated into the soft foam core of a surfboard. Extensions of the fin can be inserted into these openings and locked by means of a grub screw. The disadvantage of this design is that the mounting cannot be carried out without tools. In addition, laminating the holding body into a board is a laborious process that is only possible with boards that provide sufficient space. With wakeboards or kiteboards, for example, which have a relatively thin main body, such a connection of the fins by means of a laminated body is usually not possible.

Furthermore, fin arrangements that can be assembled and disassembled without tools are known in which a fin is mounted on a laminated holding body via a spring element. By overcoming a spring force, the fin can be separated from the water sports device without tools. A disadvantage of known designs with fins held by spring elements is that these are often not suitable for being subjected to loads in both moving directions without causing the fin to detach from the main body. With conventional constructions, the disadvantage is that the fin separates from the main body of the water sports device when it collides with the ground against the predetermined main moving direction.

Furthermore, with conventional systems there is the problem that the extensions of the fin must be placed in openings to connect to the sports device. These openings tend to get clogged, making it impossible to insert the extensions.

SUMMARY

The task of the invention is now to overcome the disadvantages of the prior art and, in particular, to provide a fin arrangement for a water sports device in which the fins can be easily connected to the main body of the water sports device and in which a reliable connection of the fin with the main body of the water sports device can be established, even if the water sports device is operated in both moving directions.

In one embodiment, the present disclosure relates to a fin arrangement for a water sports device, comprising a base body and a fin which is detachably connected or connectable to the base body via a spring element without the use of tools, wherein the base body has a mounting surface for resting against the sliding surface of the main body of the water sports device, and wherein the fin has a recess for receiving at least part of the base body.

Optionally, it is provided that a latching cam and a latching recess are provided and/or that the spring element in the assembled position is inserted into the latching recess.

Optionally, it is provided that the latching cam is arranged along the movement curve of the spring element when establishing the assembled position.

Optionally, it is provided that in order to bring the fin into its assembled position, the spring element must be elastically deformed in such a way that the spring element can be inserted into the latching recess over the latching cam.

Optionally, it is provided that the spring element in the assembled position is held in the latching recess in a force-locking or positively locking manner behind the latching cam.

Optionally, it is provided that the spring element is at least temporarily compressible and thereby pre-tensionable to get past the latching cam when the fin is separated from the base body.

Optionally, it is provided that the spring element in the assembled position extends to the outside and/or is accessible from the outside.

Optionally, it is provided that the spring element is manually compressible and thereby pre-tensionable to get past the latching cam when the fin is separated from the base body.

Optionally, it is provided that two spring elements are provided which are arranged on both sides of the longitudinal direction of extension and are spring-mounted transversely to the longitudinal direction of extension.

Optionally, it is provided that the two spring elements are designed in such a way that when the base is inserted into the recess of the fin, they lock automatically behind respective latching cams and can be released by pressing manually on both sides.

Optionally, it is provided that a longitudinal positive locking extension is provided which can be inserted into a longitudinal positive locking cutout, the longitudinal positive locking extension being provided on one of the elements base body or fin and the longitudinal positive locking cutout being provided on the respective other element, so that the longitudinal positive locking extension can be inserted into the longitudinal positive locking cutout by connecting the fin to the base body.

Optionally, it is provided that the longitudinal positive locking extension introduced into the longitudinal positive locking cutout is provided for locking a degree of freedom which may act along the longitudinal direction of extension.

Optionally, it is provided that the spring element comprises an end supported on another portion of the spring element, whereby the spring element is wrapped or formed in a spiral manner, and/or that the spring element comprises a wrapped or spiral portion, and/or that the region of the spring element which is elastically deformed in order to generate a spring force is wrapped or formed in a spiral manner.

In one embodiment, the present disclosure relates to a water sports device comprising a main body having a sliding surface for moving on a water surface in a sliding manner and a fin arrangement, wherein the mounting surface of the base body of the fin arrangement is arranged on the sliding surface of the main body of the water sports device.

Optionally, it is provided that the base body protrudes along the normal direction of extension from the main body or from the mounting surface or sliding surface of the water sports device.

Optionally, it is provided that the base body is arranged outside, in particular completely outside, of the main body of the water sports device and is preferably uncovered with the exception of the mounting surface.

Optionally, it is provided that fastening means are provided for connecting the base body to the main body, and that the fastening means are inserted into fastening means openings in order to provide the connection of the base body to the main body.

Optionally, it is provided that a screw connection is provided in which fastening means in the form of screws are screwed through the main body into the fastening means openings of the base body.

Optionally, it is provided that the water sports device comprises a solid main body with a wooden core or a solid plastic core.

The sliding surface is, in particular, that side of the water sports device which faces the water during operation and which is designed, in particular, for moving on a water surface in a gliding manner, this surface preferably extending also under the fin or under the base body and, optionally, in the region under the fin or under the base body having a profile deviating from the other profile of the surface. For example, the sliding surface below the fin or below the base body can be plane or curved.

In the following, the present disclosure describes several exemplary embodiments.

BRIEF DESCRIPTION OF THE DRAWINGS

FIGS. 8 and 9 show schematic sectional views of the embodiment of FIG. 7 in two different positions.

DETAILED DESCRIPTION OF THE PREFERRED EMBODIMENTS

Figure 1:
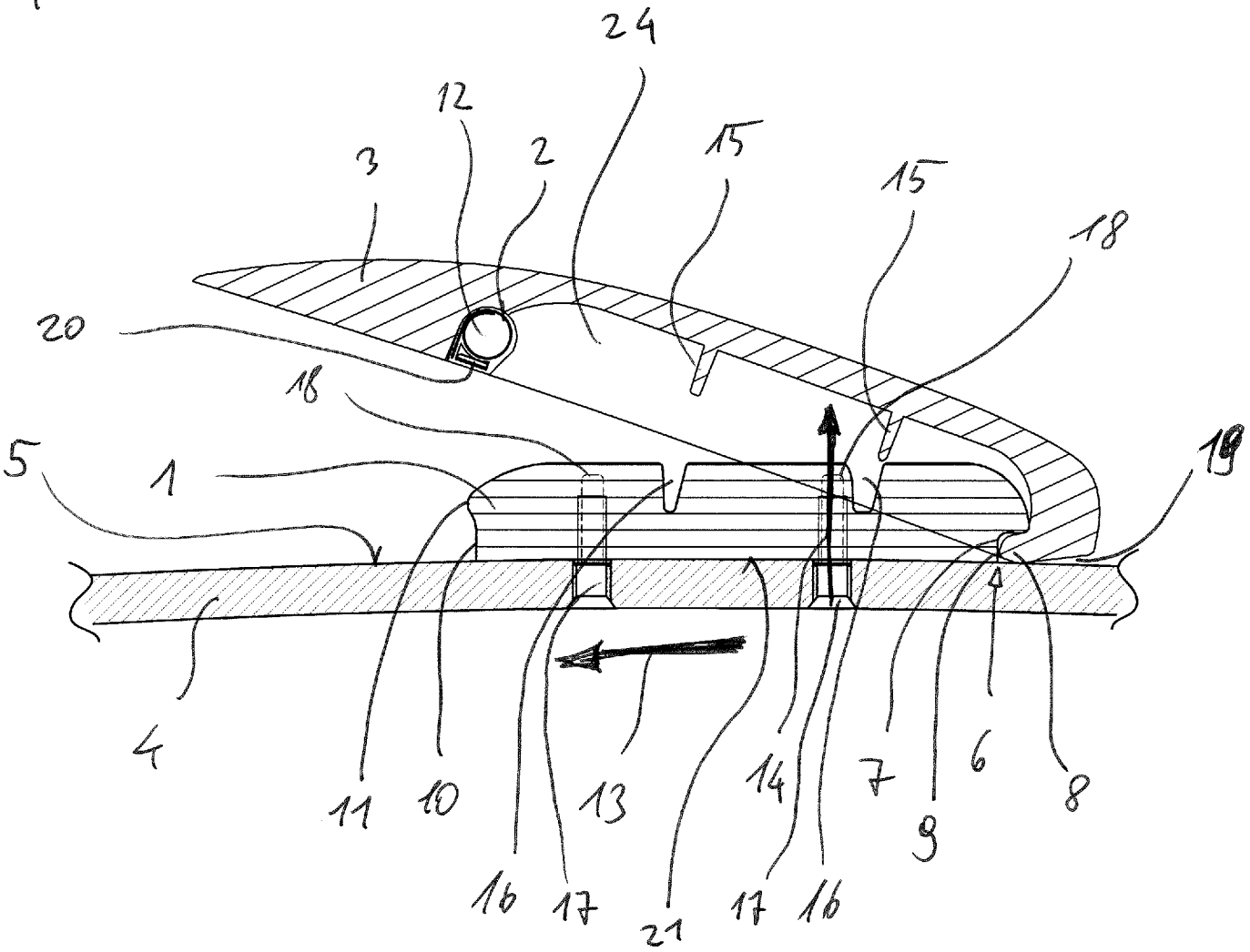
FIGS. 1 to 3 show schematic sectional views of a possible embodiment in three different positions.

Unless otherwise specified, the reference signs correspond to the following components: Base body 1, spring element 2, fin 3, main body (of the water sports device) 4, sliding surface (of the water sports device) 5, hook pairing 6, hook groove 7, hook extension 8, pivot axis 9, latching recess 10, latching cam 11, spring retainer 12, longitudinal direction of extension 13, normal direction of extension 14, longitudinal positive locking extension 15, longitudinal positive locking cutout 16, fastening means 17, fastening means opening 18, pivot recess 19, spring fastening element 20, mounting surface 21, taper 22, fin surface 23, recess 24.

FIG. 1 shows a possible embodiment of a fin arrangement and a part of the water sports device comprising an inventive fin arrangement. A base body 1 of the fin arrangement is mounted with its mounting surface 21 on the main body 4 of the water sports device, whereby the mounting surface 21 rests against the sliding surface 5 of the water sports device. In the present embodiment, the base body 1 is connected to main body 4 by fastening means 17. These fastening means 17 are inserted into fastening means openings 18 in order to make the connection between base body 1 and main body 4. In particular, a screw connection is provided with the present embodiment in which fastening means 17 designed as screws are screwed through the main body 4 into fastening means openings 18 of the base body 1. Such a configuration is particularly possible for water sports devices with a solid main body, for example a main body with a wooden core or a solid plastic core.

The base body 1 protrudes along the normal direction of extension 14 from the main body 4 or from the mounting surface 21 or the sliding surface 5 of the water sports device. Thus, the base body 1 is arranged outside, preferably completely outside, of the main body 4 of the water sports device and, with the exception of the mounting surface 21, uncovered. This configuration makes it possible, for example, to easily clean the elements connecting the fin 3 to the base body 1. This configuration can be provided in all embodiments.

The fin 3 can be connected without tools to the base body 1. The fin 3 can also be separated from the base body 1 without tools. For this purpose, the fin arrangement comprises a hook pairing 6. This hook pairing 6 serves the partial connection of the fin 3 with the base body 1. Due to the hook pairing 6, in particular, the degree of freedom of the fin 3 with respect to the base body 1, which runs along the normal direction of extension 14, is blocked which would thus permit a translational withdrawal of the fins 3 from the base body 1 along the normal direction of extension 14. Optionally, at least one other degree of freedom is also blocked by the hook pairing 6, in particular a degree of freedom running along the longitudinal direction of extension 13. Preferably, however, one degree of freedom, in particular a degree of freedom of rotation or pivoting, remains free. The hook pairing 6 preferably comprises a hook groove 7 and a hook extension 8, one of the elements being provided on the base body 1 and the other element on the fin 3.

In the present design, the fin 3 comprises a hook extension 8 which projects and/or can be inserted into a hook groove 7 of the base body 1. For assembly, as shown in FIG. 1, in a first step the hook extension 8 is inserted into the hook groove 7. A spring element 2 and a latching recess 10 are also provided. To connect the fin 3 to the base body 1, the spring element 2 is now inserted into the latching recess 10. Preferably a latching cam 11 is provided, which is arranged along the movement curve of the spring element 2. The movement curve of the spring element 2 is particularly determined by the kinematics of the hook pairing 6. Preferably a pivot axis 9 is formed by the hook pairing 6. Optionally, the kinematics of the hook pairing 6 can vary the position of the pivot axis 9 depending on the position of the fin 3 relative to the base body 1. The pivot axis 9 preferably runs in all embodiments perpendicular to the longitudinal direction of extension 13 and perpendicular to the normal direction of extension 14, and in particular transversely to the direction of travel of the water sports device.

The spring element 2 of the present embodiment is arranged and can be arranged in a spring retainer 12. In the present embodiment the spring retainer 12 is located in the fin 3, whereby the spring element 2 is arranged at and/or in the fin 3. In all embodiments, spring element 2 may be at least partially formed in a spiral manner and preferably comprises a rounded or cylindrical or semi-cylindrical outer surface and/or a rounded or cylindrical or semi-cylindrical portion. Optionally, the spring element 2 can be provided with play in the spring retainer 12. Optionally, a spring fastening element 20 is provided which allows the mounting and holding of spring element 2 in the spring retainer 12. For example, the spring retainer 12 may have an opening larger than the envelope of spring element 2 so that spring element 2 can be inserted into the spring retainer 12. Consequently, the spring retainer 12 may be closed by the spring fastening element 20 in such a way that the spring element 2 is locked or held in the spring retainer 12. Such an arrangement of the spring element 2 in the spring retainer 12 can be provided in all embodiments.

The fin arrangement according to FIG. 1 comprises a longitudinal positive locking extension 15 which can be inserted into a longitudinal positive locking cutout 16. Preferably, the longitudinal positive locking extension 15 is located on one of the elements: Base body 1 or fin 3 and the longitudinal positive locking cutout 16 is provided on the respective other element, so that by connecting the fin 3 with the base body 1 the longitudinal positive locking extension 15 is introduced into the longitudinal positive locking cutout 16. The longitudinal positive locking extension 15 inserted into the longitudinal positive locking cutout 16 is in particular configured to lock a degree of freedom possibly acting along the longitudinal direction of extension 13. In the present embodiment, two longitudinal positive locking extensions 15 and two longitudinal positive locking cutouts 16 are provided. The longitudinal positive locking extensions 15 are each provided on the fin 3. The longitudinal positive locking cutouts 16 are each provided in the base body 1.

In addition, the fin 3 comprises a pivot recess 19. The pivot recess 19 is designed in such a way that a pivotal movement of the fin 3 relative to the base body 1 about the pivot axis 9 is possible without a collision of the fin 3 with the main body 4 or with the sliding surface 5 of the main body 4.

Figure 2:
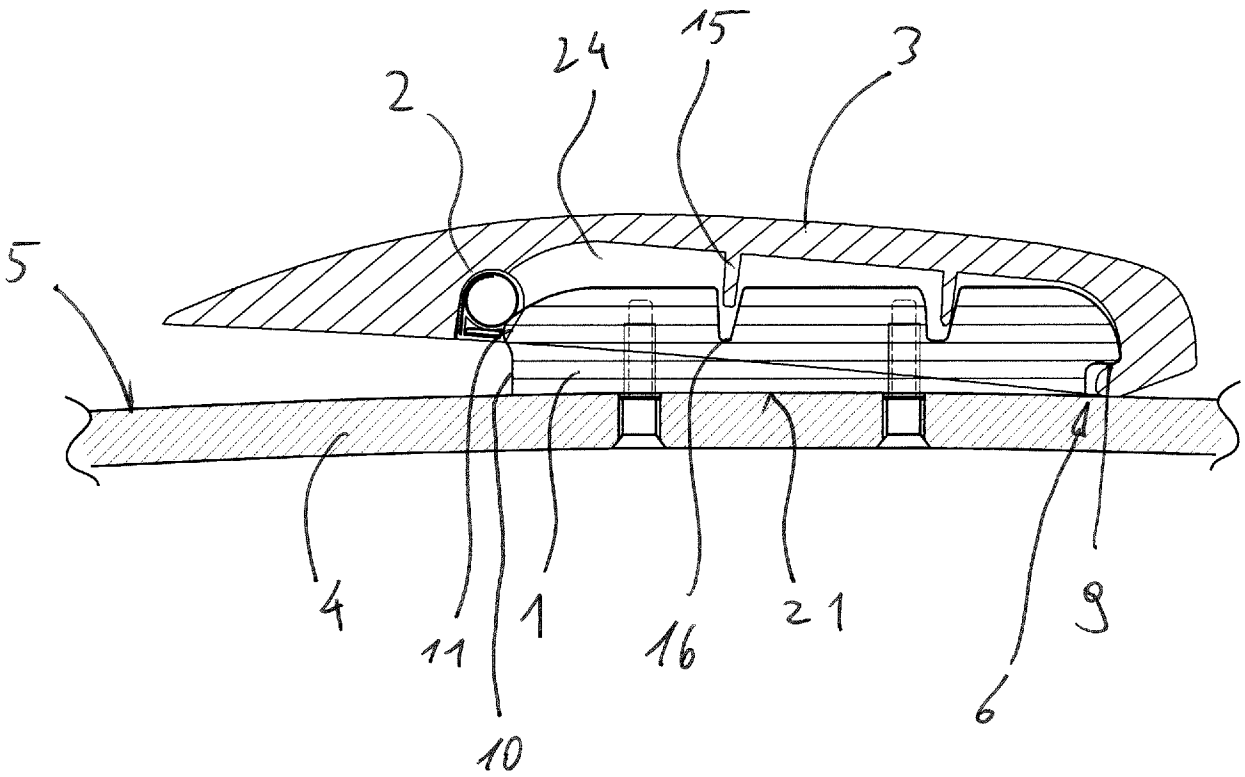

FIG. 2 shows the fin arrangement of FIG. 1 in a further pivotal position. The fin 3 is pivoted about the pivot axis 9 relative to the base body 1 in such a way that the spring element 2 rests on the latching cam 11 along its movement curve. In all embodiments, the latching cam 11 projects in particular into the movement curve of the spring element 2 about the pivot axis/axes 9. In order to bring the fin 3 into its assembled position, the spring element 2 must be elastically deformed in such a way that the spring element 2 can be inserted into the latching recess 10 over the latching cam 11. For this purpose, the spring element 2 is designed springily. During the pivotal movement, at least one longitudinal positive locking extension 15 is also inserted into a longitudinal positive locking cutout 16.

Figure 3:
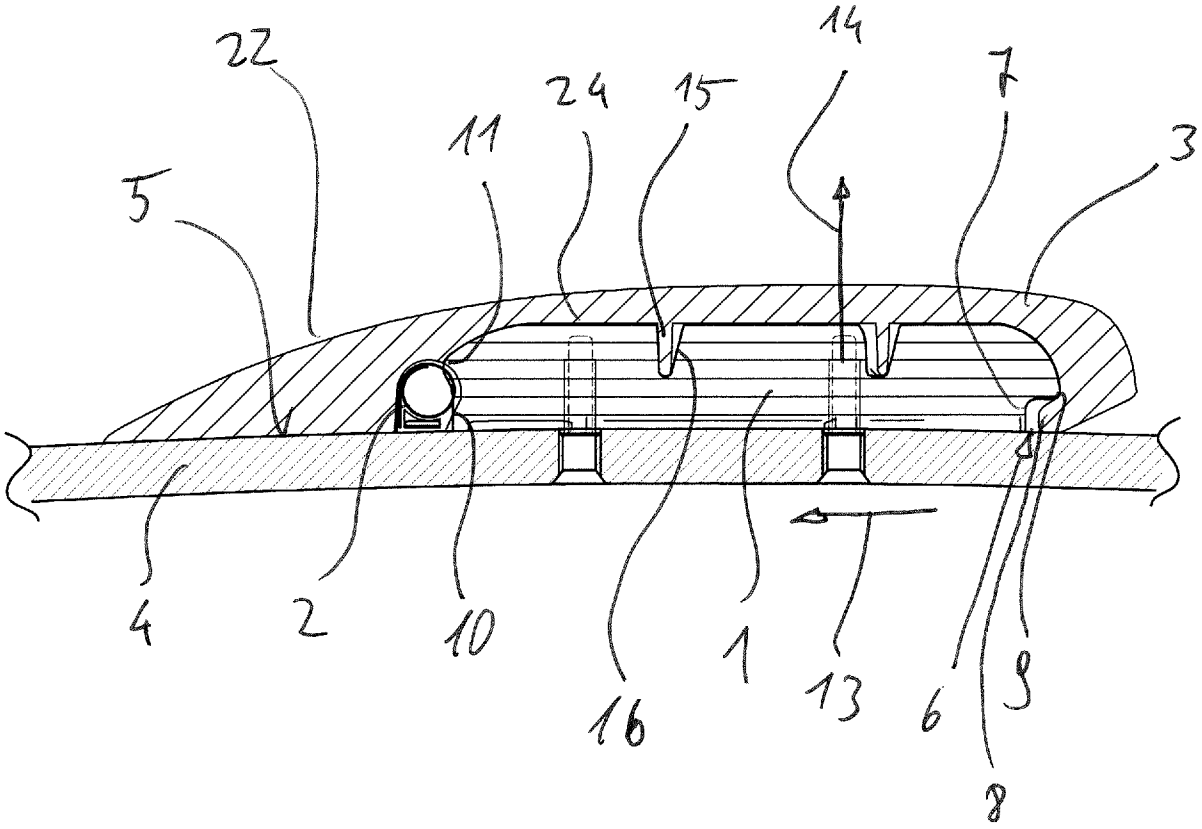

FIG. 3 shows the design of FIGS. 1 and 2, with fin 3 in its assembled position. In this position it is possible to operate the water sports device using the fin arrangement and the fin 3 is connected to the base body 1 and in particular to the main body 4 of the water sports device. In the position of FIG. 3 the spring element 2 is moved along the movement curve past the latching cam 11 and inserted into the latching recess 10. In order to get past the latching cam 11, the spring element 2 must be compressed at least temporarily and thus pre-tensioned. The spring element 2 is also preferably pre-tensioned in its assembled position, so that the fin 3 is substantially connected without play to the base body 1 in the longitudinal direction of extension 13. Preferably the hook extension 8 is pulled into the hook groove 9 by the pre-tensioning force. The design of the recess 24 of the fin 3 and of the spring element 2 forms a clasp which engages with two opposite sections, in particular formed by the spring element 2 and the hook extension 8, in two undercut regions of the base body in order to enable the fin 3 to be mounted on the base body 1. The undercut regions are formed in particular by the hook groove 9 and the latching recess 10.

Preferably, that surface of the fin 3 which faces the main body 4 or the sliding surface 5 of the water sports device is adapted to the shape and the profile of the sliding surface 5, so that this surface is in contact with the sliding surface 5. In addition, preferably one or more longitudinal positive locking extensions 15 are inserted into longitudinal positive locking cutouts 16 in order to lock a degree of freedom acting along the longitudinal direction of extension 13. In particular, the hook pairing 6 is designed in such a way that the hook extension 8 projects into the hook groove 7, thereby inhibiting the separation of the hook pairing 6 along the normal direction of extension 14. In order to detach the fin 3 from the base body, the fin 3 must be pulled off the main body 4 of the water sports device along the normal direction of extension 14 in an area remote from the hook pairing 6. This compresses the spring element 2 so that it can be moved past the latching cam 11 in order to move the spring element 2 out of the latching recess 10 and in order to subsequently be able to separate the fin 3 from the base body 1.

The fin 3 optionally comprises, in all embodiments, a taper 22 extending at an angle and/or rounded from the, when viewed along the normal direction of extension, outermost point of the fin 3 towards the sliding surface 5 of the main body 4. In particular, this taper 22 prevents any objects hitting the fin 3 from this direction from getting caught in the fin 3. In particular, this prevents the fin 3 from being separated from the base body 1 by such objects. The hook pairing itself prevents the fin 3 from being pulled off the base body 1 in the area of the hook pairing 6.

In particular, the present configuration ensures that fin 3 can be operated in both operating directions along the longitudinal direction of extension 13 without fin 3 separating from the base body 1.

Figure 4:
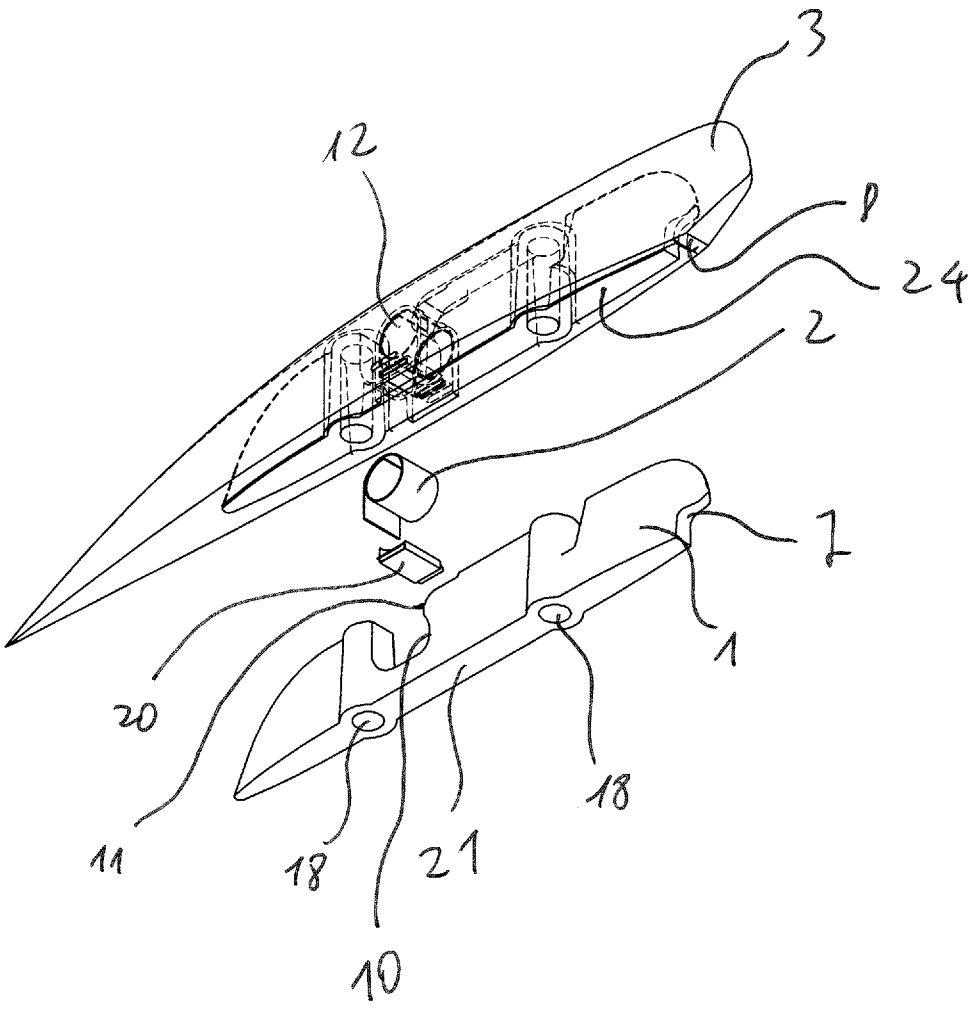
FIG. 4 shows a schematic exploded view of another embodiment.

FIG. 4 shows a further embodiment of a fin arrangement in an exploded view. The fin arrangement comprises a base body 1 and a fin 3 which can be connected to the base body 1 via a spring element 2 and a hook arrangement 6. The base body 1 again comprises a mounting surface 21 and fastening means openings 18 for connection to a main body of a water sports device. The base body further comprises a latching cam 11 and a latching recess 10 to provide a connection of the base body 1 with the fin 3. In addition, the fin arrangement comprises a hook groove 7 and a hook extension 8 for forming the hook pairing 6. The spring element 2 is again provided via a spring fastening element 20 in a spring retainer 12 of the fin 3.

Figure 5:
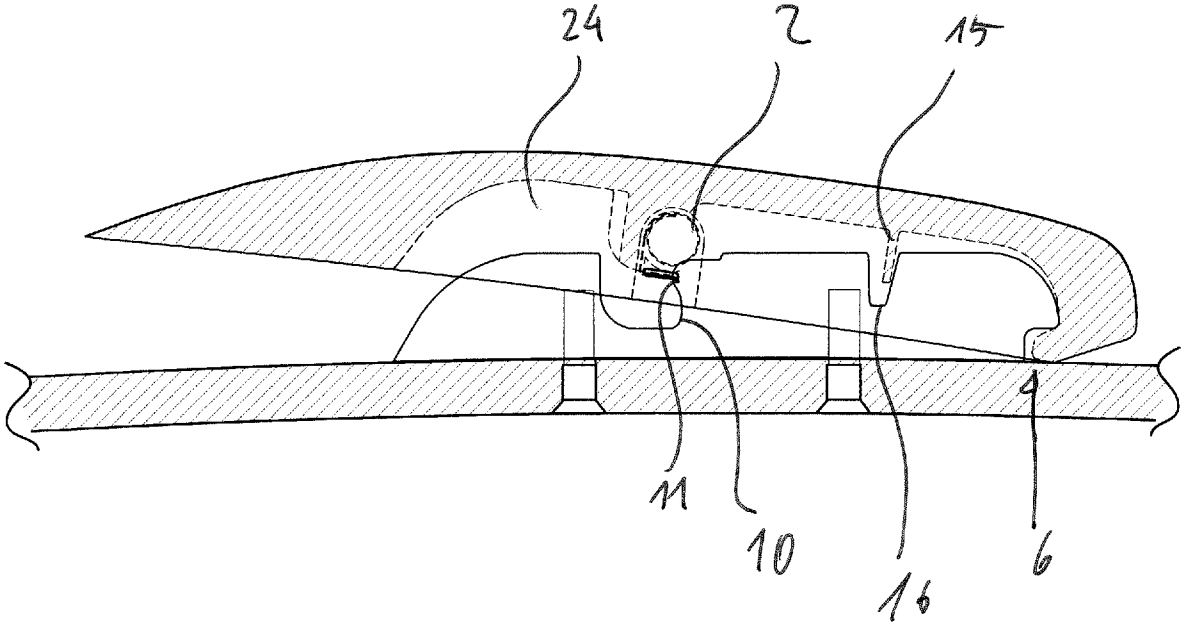
FIGS. 5 and 6 show two schematic sectional views of the embodiment of FIG. 4 in two different positions.

FIG. 5 shows a further view of the embodiment of FIG. 4 in a position in which the spring element 2 rests against the latching cam 11, whereby the spring element 2 can be inserted across the latching cam 11 into the latching recess 10 by overcoming the spring force. The mode of operation of the embodiment of FIG. 5 essentially corresponds to the mode of operation of the embodiment of FIGS. 1 to 3, whereby in contrast to FIGS. 1 to 3, in FIG. 5 the latching cam 11 is provided along the longitudinal direction of extension 13 of the base body 1 inside the base body 1. In FIGS. 1 to 3, in contrast, the latching cam 11 forms an ending of base body 1 or the latching cam 11 is located at one end of base body 1.

The mode of operation of the hook pairing 6 as well as the pairing of a longitudinal positive locking extension 15 and a longitudinal positive locking cutout 16 essentially corresponds to that of FIGS. 1 to 3.

Figure 6:
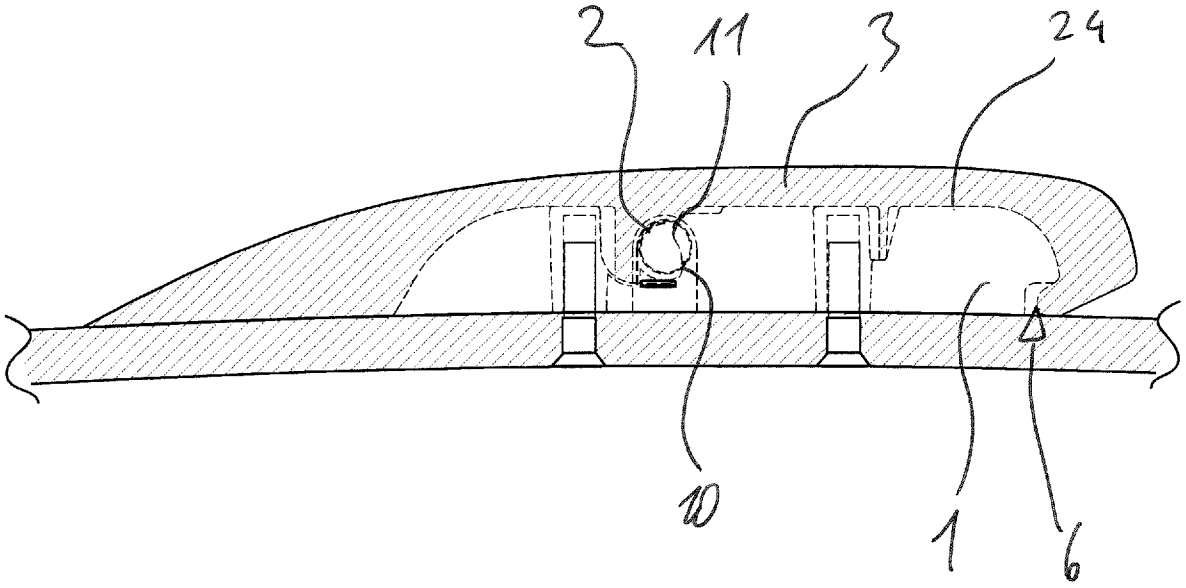

FIG. 6 shows the same embodiment as FIGS. 4 and 5, the fin 3 being in its assembled position, in which the spring element 2 moves along its movement curve past the latching cam 11 by elastic deformation and is inserted into the latching recess 10. The movement curve of spring element 2 is again defined by the kinematic arrangement of the hook pairing 6.

In the embodiments of FIGS. 1 to 6, spring element 2 is provided on or connected to fin 3. In particular, the fin 3 in the embodiments of FIGS. 1 to 6 comprises an inner space in which the spring element 2 is provided. The base body can also be inserted into this inner space in order to connect the fin 3 with the base body 1. In particular, the base body 1 is completely inserted into the inner space in the embodiments of FIGS. 1 to 6, so that in the assembled position only the outer surface of the fin 3 is visible from the outside.

In the embodiments of FIGS. 1 to 6, the base body 1 is firmly connected to the main body of the water sports device. The base body 1 protrudes from the sliding surface 5 of the main body 4. In these embodiments, the spring element 2 is arranged on the fin 3. The advantage of this is that the recess 24 provided in the fin 3 for the connection to the base body 1, in which preferably also the spring element 2 is arranged, can be easily removed and thus easily cleaned. For example, soiling of the spring element 2 or the cavity in the fin 3 can be easily remedied.

Figure 7:
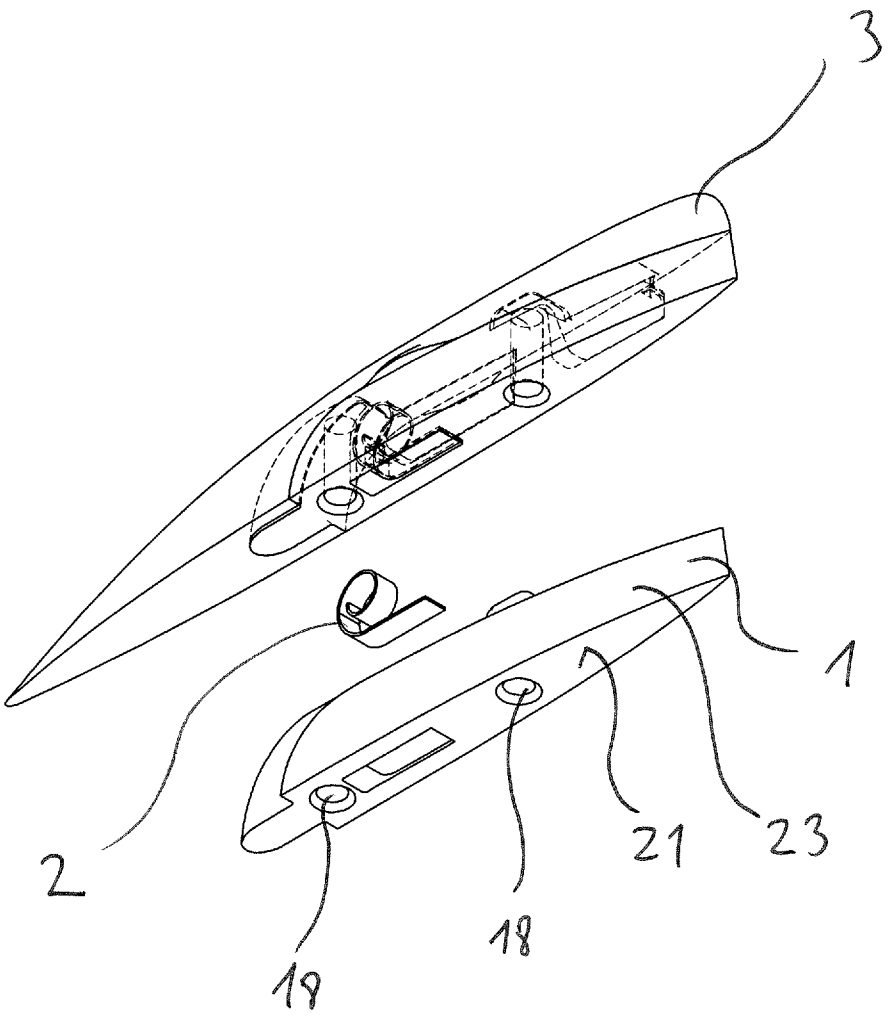
FIG. 7 shows an exploded view in a schematic view of another embodiment.

FIG. 7 shows a further embodiment of a fin arrangement, the arrangement comprising a base body 1, a spring element 2 and a fin 3. In the present embodiment of FIG. 7 the spring element 2 is provided on the base body 1. The fin 3 comprises a recess 24 into which parts of the base body 1 or the spring element 2 can be inserted. The base body 1 comprises a mounting surface 21 adapted to the sliding surface 5 of the water sports device as well as fastening means openings 18 for fastening the base body 1 to the main body 4 of the water sports device. In the present embodiment, the base body 1 comprises an external fin surface 23, which together with the removable fin 3 forms the entire fin. In particular, the profile of the fin surface 23 is adapted to the profile of the outer surface of the fin 3, so that a fin-shaped body is formed by merging the fin 3 with the base body 1.

Figure 8:
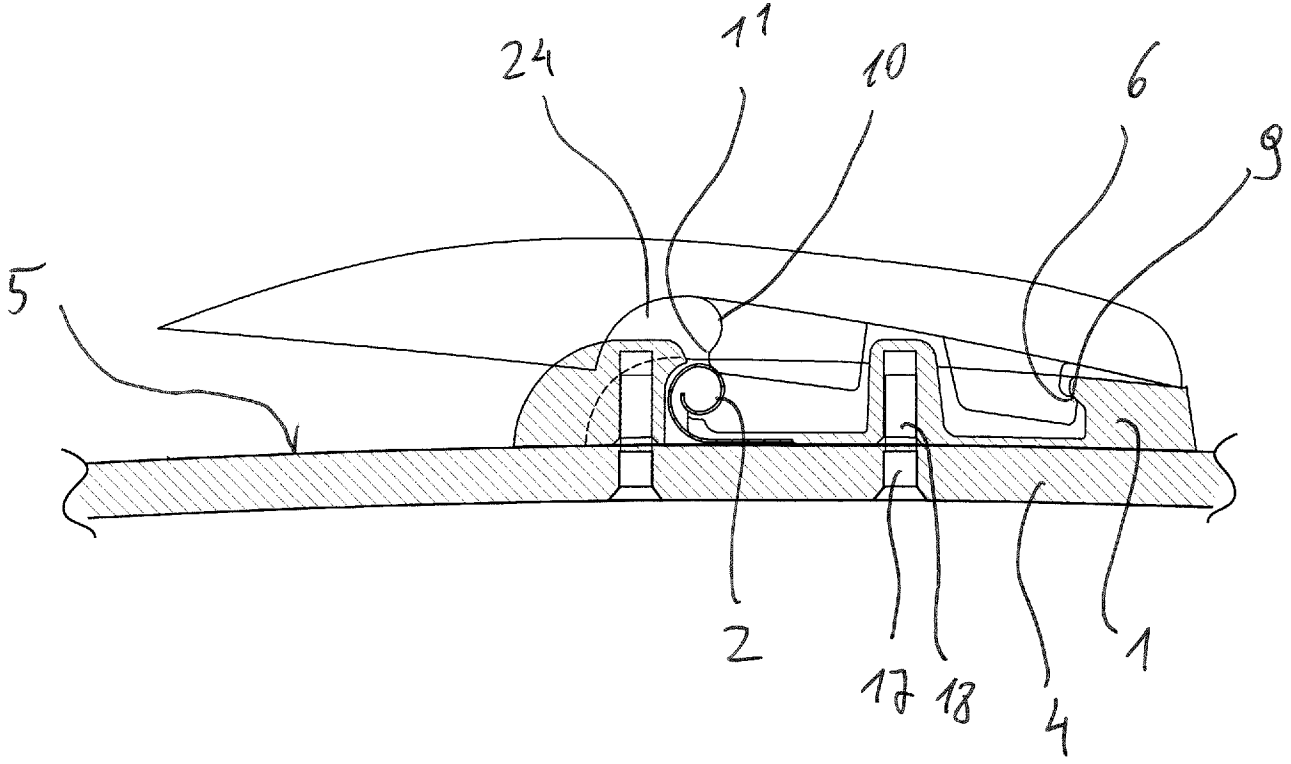
Figure 8:
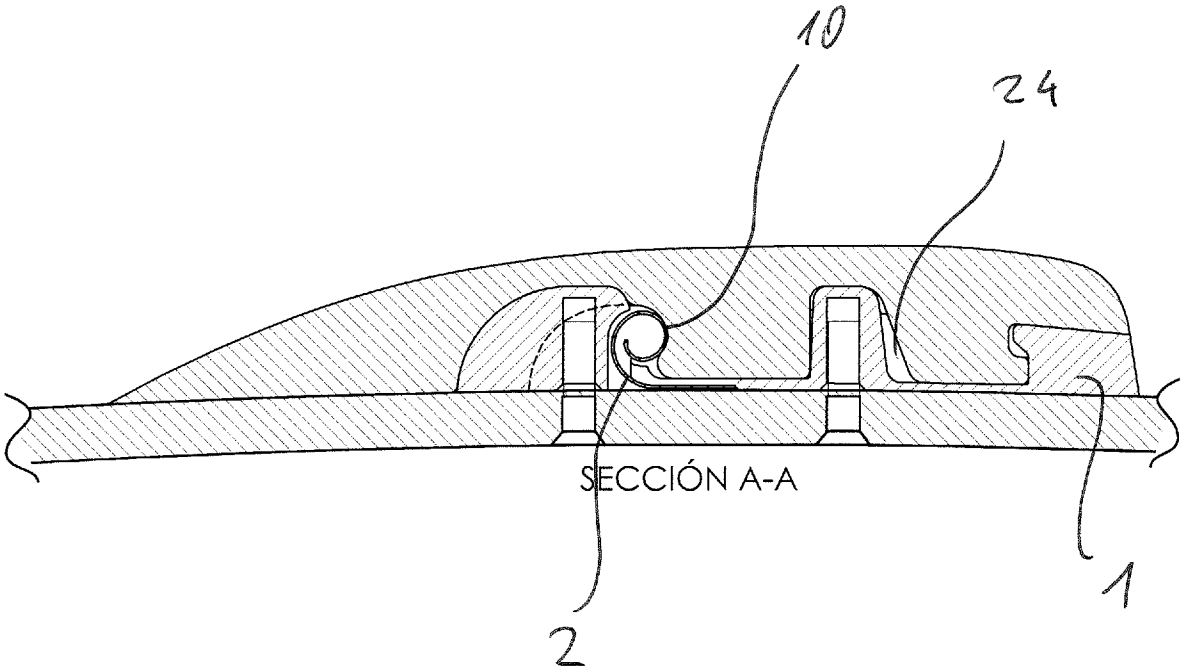

FIG. 8 shows a schematic sectional view of the embodiment of FIG. 7 in a position in which the latching cam 11 rests against the spring element 2. The spring element 2 in this embodiment is arranged on the base body 1. The base body 1 is provided via fastening means 17 and fastening means openings 18 on the main body 4 and in particular on the sliding surface 5 of the main body 4 of the water sports device. The latching cam 11 is provided at the fin 3. The fin 3 can be connected to the base body via a hook pairing 6 and, in particular, can be connected in a pivoting manner about a pivot axis 9. The spring element 2 is provided along the direction of movement of the latching cam 11, so that the latching cam 11 only after overcoming the spring force of the spring element 2 can be moved in such a way that the spring element 2 can be inserted into the latching recess 10. The latching recess 10 is also provided on fin 3 in the present embodiment.

FIG. 9 shows the same embodiment as FIGS. 7 and 8, with the fin 3 in its assembled, operational position. The spring element 2 arranged on the base body 1 is inserted into the latching recess 10, whereby the fin 3 is held on the base body 1.

Figure 10:
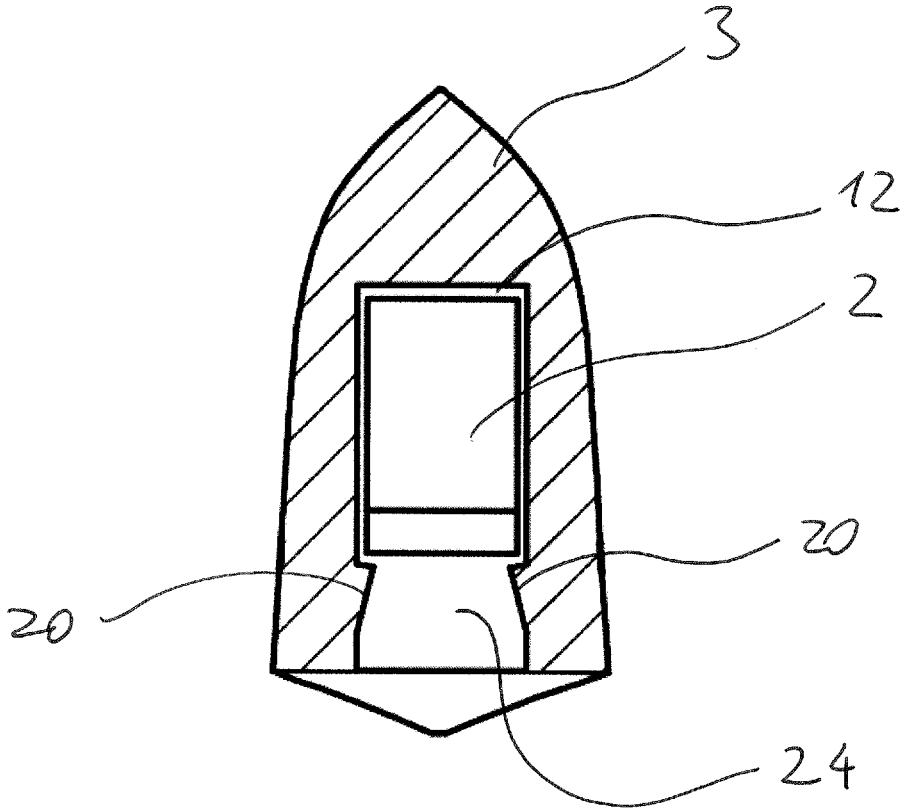
FIG. 10 shows a schematic sectional view in the area of a spring element.

FIG. 10 shows another embodiment in which the spring element 2 is fastened in the spring retainer 12 via a spring fastening element 20. The spring fastening element 20 is formed as a wedge-shaped element extending inwardly from the inner wall of the recess 24 along the insertion direction or the insertion direction of the spring element 2 in order to form a continuous narrowing of the recess 24 along the insertion path of the spring element 2. When the spring element 2 is inserted, the wedge-shaped design slightly deforms the fin 3 or the spring fastening element 20, making it possible to insert the spring element 2 despite the narrowing. If the spring element 2 is inserted over the spring fastening element 20 into the spring retainer 12, the fin 3 or the spring fastening element 20 moves back into its initial position. In particular, the spring fastening element 20 comprises a terminating edge so that the spring element 2 is held in the spring retainer 12 by a hook-shaped or clip-shaped extension. The free passage width in the area of the wedge-shaped spring fastening element 20 is smaller than the width of the spring element 2, whereby the spring element 2 is held in the spring retainer 12. Optionally, the spring fastening element 20 is formed by two opposite wedge-shaped extensions. Optionally, the spring fastening element 20 is connected in one piece to the fin 3 or is part of the fin 3.

In all embodiments, the longitudinal positive locking extension 15 may be in the form of a bar-shaped extension located within the recess 24 of the fin 3. Due to this form, which is shown, for example, in FIGS. 1 to 6, the longitudinal positive locking extension 15 also serves as a reinforcement element for fin 3. As shown for example in FIG. 4, the recess 24 is a narrow elongated recess preferably extending over a substantial part of the inner space of the fin 3. The fin is thus substantially formed as a hollow body. In order to reinforce the side walls of the fin 3 against each other, the longitudinal positive locking extensions 15 may extend from the bottom of recess 24 into the recess 24, thereby connecting the two side walls of the recess 24 to each other in the area of the recess 24. According to another embodiment not shown, it may be provided that the elements designated as longitudinal positive locking elements 15 are designed exclusively as reinforcing elements. In this embodiment, no longitudinal positive locking cutouts 16 are provided. However, a longitudinal positive lock can still be achieved, for example, by the clasp-shaped design of the fin 3, in particular by the combination of the latching recess 10 and the hook pairing 6.

Optionally, it can be provided in all embodiments that the spring element 2 is formed in a spiral manner. In particular, the spring element 2 has at least in sections a cylindrical or rolled shape, preferably one end of the spring element 2 being supported on a further section of the spring element 2. This may form a rounded outer surface which allows the latching cam 11 to be passed in a sliding manner without any jamming or a permanent positive lock. Furthermore, the spring element 2 has an elasticity which makes it possible, when a certain force is applied, to guide the spring element 2 past the latching cam 11 by compressing the spring element 2. The spring element is preferably arranged in such a way that the rounded outer surface points in the direction of the latching cam 11 when passing over the latching cam 11.

Optionally, it may be provided in all embodiments that the spring element 2 comprises an end or a portion which is supported on a further section of the spring element 2, whereby the spring element 2 is wrapped or formed in a spiral manner, and/or that the spring element 2 comprises a section which is wrapped or formed in a spiral manner.

Preferably it is provided that the elastically deformed section of the spring element 2 is wrapped or formed in a spiral manner to generate a spring force.

Due to the wrapped or spiral design of the spring, the spring element 2 may have a progressive spring characteristics. Furthermore, the self-supported spring element 2 designed in this way can easily be provided in a spring retainer 12. With pre-tensioned spring tongues, in contrast, clamping of the springs must be provided.

Optionally, it is provided in all embodiments that the fin arrangement has an assembled position, wherein in the assembled position the spring element 2 is arranged in the latching recess 10, and/or in which at least one longitudinal positive locking extension 15 is arranged in a longitudinal positive locking cutout 16, and/or in which the hook pairing 6 is closed, and/or in which a hook extension 8 projects into a hook groove 7, and/or in which the base body 1 is introduced into the recess 24, and/or in which the base body 1 is completely inserted into the recess 24, and/or in which the surface of the fin 3 facing the main body 4 is formed flush with the mounting surface 21 of the base body, wherein the overall surface formed by these two surfaces is preferably adapted to the shape of the sliding surface 5 of the main body 4 of the water sports device and/or in which the fin 3 is connected to the base body 1 via the spring element 2 and the hook pairing 6.

Optionally, it is provided in all embodiments that the main body 4 of the water sports device is a main body with a solid core, such as a solid plastic core or a wooden core. Optionally, it is provided in all embodiments that the base body 1 has fastening means openings 18 into which fastening means 17 for fastening the base body 1 to the main body 4 are inserted, the fastening means 17 preferably being guided through the entire main body.

Optionally, it is provided in all embodiments that the spring element 2 is supported with one end on a further section of the spring element 2, and/or that the spring element is substantially wrapped or formed in a spiral manner, and/or that the spring element has an extension, in particular an end, which is guided in a manner deviating from a round shape and serves, for example, as an anti-rotation means for the spring element, and/or that the spring is formed from a metallic material, for example spring steel, a thin metal plate or a similar material.

Optionally, it is provided in all embodiments that the spring element 2 is arranged in a spring retainer 12, whereby the spring element 2 is preferably inserted with play in the spring retainer 12.

Optionally, it is provided in all embodiments that the base body 1 extends from the sliding surface 5 of the water sports device along the normal direction of extension 14, and in particular is arranged entirely outside the main body 4 of the water sports device.

Optionally, it is provided in all embodiments that the recess 24 of fin 3 is provided to accommodate base body 1.

Optionally, it is provided in all embodiments that the water sports device has a preferred direction of movement and that along the preferred direction of movement the spring element 2 is arranged in the front region of the fin arrangement and the hook pairing 6 is arranged in the rear region of the fin arrangement.

Optionally, it is provided in all embodiments that one or more pivot axes 9 are formed by the hook pairing 6, and that substantially all degrees of freedom except for a pivotal movement about the pivot axes 9 are inhibited by the configuration of the fin arrangement. The pivoting about the pivot axis 9 is only possible from the assembled position after overcoming a holding force generated by the spring element 2 and the latching cam 1. Optionally, it is provided that in order to separate the fin 3 from the base body 1, a movement along a degree of freedom takes place in which the fin 3 is pivoted with an initial pivotal movement which runs substantially along the normal direction of extension.

Optionally, it is provided in all embodiments that the spring element 2 is substantially formed in a cylindrical and/or spiral manner, or has a cylinder-shaped and/or spiral-shaped section, which allows an elastic deformation of the spring element when a mechanical pressure is applied from the outside.

Optionally, the water sports device in all embodiments is a kiteboard or a wakeboard, in particular a kiteboard or a wakeboard with a solid core.

Figure 11:
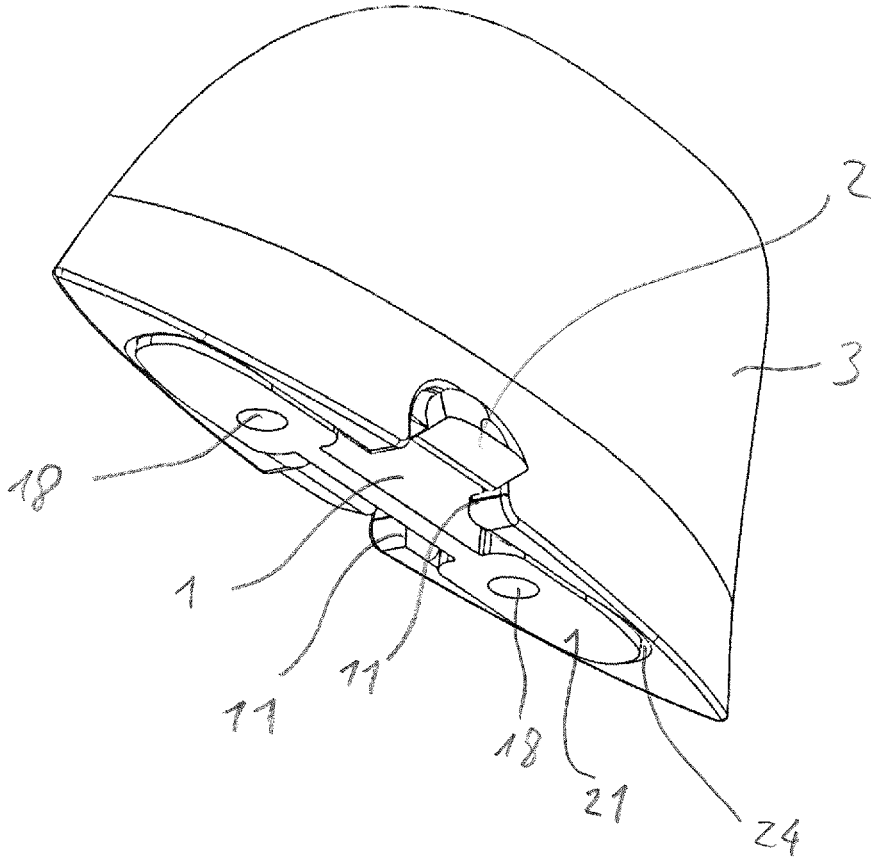
FIG. 11 shows an oblique view of a fin arrangement looking in the direction of the mounting surface.

FIG. 11 shows a fin arrangement in which the base body 1 is inserted into the recess 24 of the fin 3. For the temporary fixation of the fin 3 to the base body 1, two spring elements 2 are provided in the present embodiment. The spring elements 2 in the present embodiment extend up to the outside of the fin arrangement so that they are accessible from the outside, and in particular can be pre-tensioned by compression to release the fastening of the fin 3 to the base body 1 again. A latching cam 11 is provided for this purpose. In particular, several, in this case four, latching cams 11 are provided. To establish the connection, the fin 3 is pushed onto the base body 1, whereby the spring elements 2 are moved past the latching cams 11. If the spring elements 2 are moved past the latching cams 11, they preferably latch automatically behind these latching cams 11 to establish a connection. To release this connection again, the spring elements 2 can be compressed so that they can be moved past the latching cams 11.

The base body 1 comprises a mounting surface 21 for contacting the main body 4 of the water sports device or the sliding surface 5 of the water sports device. In particular, the mounting surface 21 may be adapted to the shape of the sliding surface 5 of the water sports device. The base body 1 preferably extends only on one side of the mounting surface 21 and is therefore preferably free of projections on the mounting surface 21. The fastening of the base body 1 to the main body 4 is preferably achieved via fastening means, which can each be inserted into a fastening means opening 18 of the base body 1 and can in particular be screwed in.

In the present embodiment the spring elements 2 are arranged on the base body 1 and in particular are part of the base body 1. In the present embodiment the latching cams 11 are arranged on the fin 3.

Figure 12:
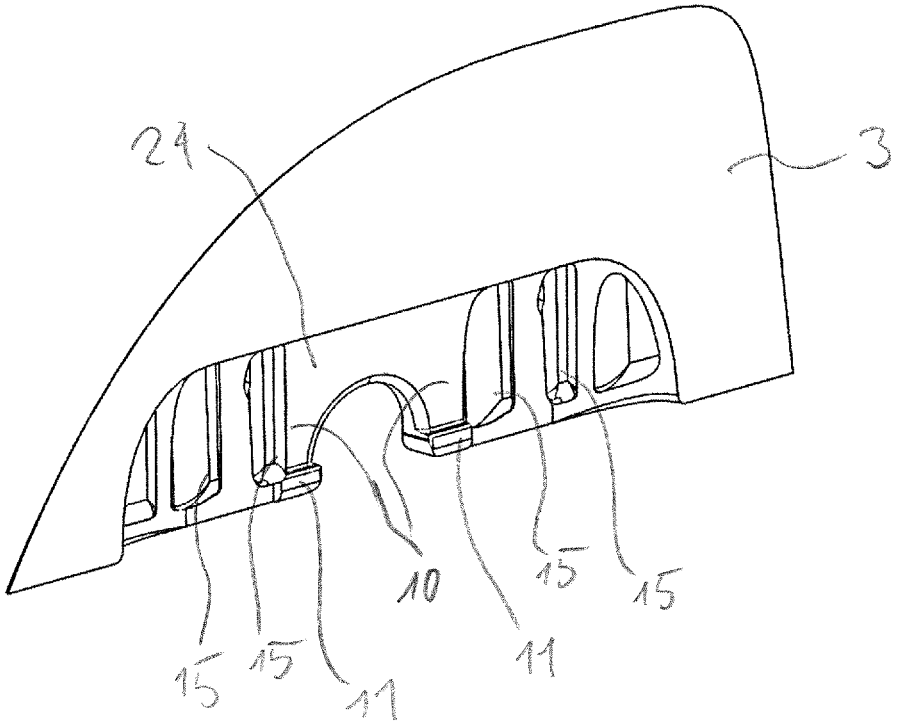
FIG. 12 shows a schematic oblique view of the fin from FIG. 11, whereby a side wall covering the recess is not visible.

FIG. 12 shows the fin 3 of FIG. 11, but with a hidden side wall, so that the interior and especially the inner shape of the recess 24 is visible. Within the recess 24, latching recesses 10 are provided behind the latching extensions 11. These latching recesses 10 are designed to accommodate the spring elements 2 or the spring element 2 of the main body 4 in the assembled position. In addition, the fin 3 comprises a number of longitudinal positive locking extensions 15. These longitudinal positive locking extensions 15 run in particular along the direction in which fin 3 is attached to base body 1. In particular, the longitudinal positive locking extensions 15 are designed to be brought into effective contact with longitudinal positive locking cutouts 16 of the base body 1 in order, for example, to effect guidance during assembly, to effect locking of a degree of freedom along the longitudinal direction in the assembled position and/or to effect reinforcement of the release 24 or the fin 3.

Figure 13A:
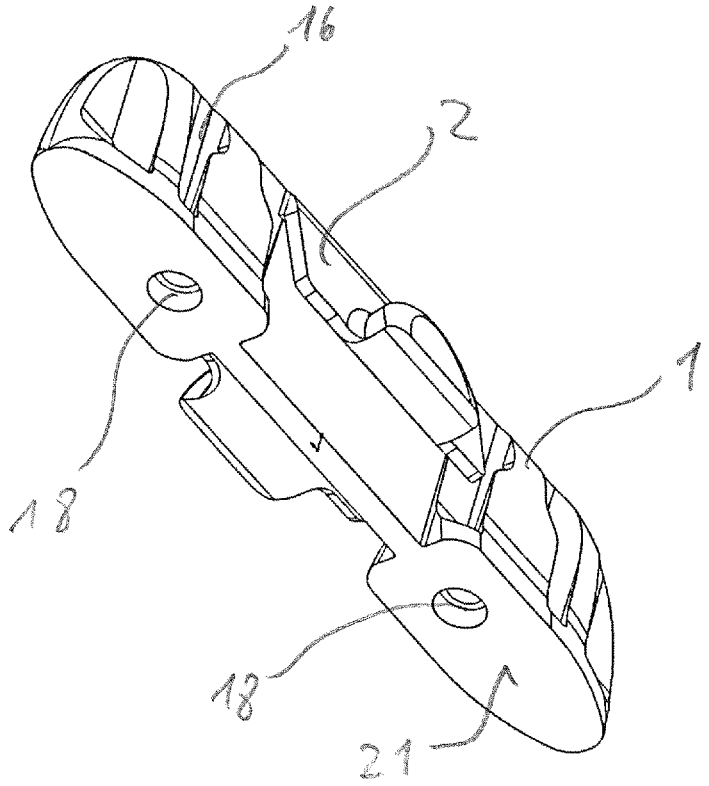
FIGS. 13*a* and 13*b* show two different oblique views of a possible base body of the embodiment of FIGS. 11 and 12.
Figure 13B:
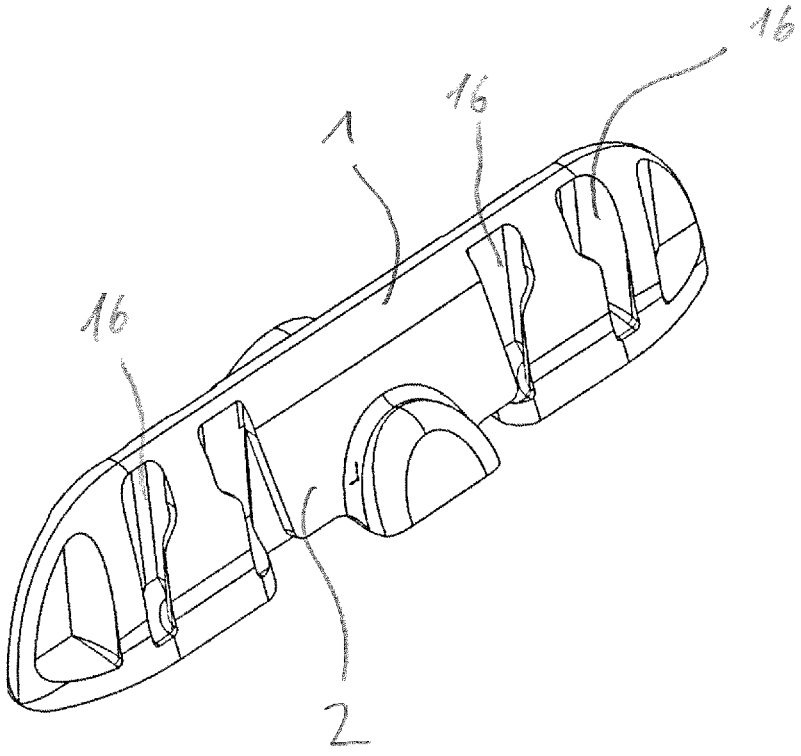

FIGS. 13*a* and 13*b* show a possible configuration of a base body 1 for use with a fin 3 of FIGS. 11 and 12. The base body 1 comprises two spring elements 2 each, which protrude from the base body 1 on both sides of the longitudinal direction of extension and are spring-mounted transversely to the longitudinal extension. In particular, the two spring elements 2 have an angled and/or wing-shaped protruding design. In the present embodiment, the two spring elements 2 run substantially plate-shaped from an upper region of the base body 1 in the direction of the mounting surface 21. The spring elements 2 are attached in particular to the base body 1 via an edge or one of their end faces and are connected in particular in one piece to this base body 1. The spring elements 2 can be moved and pre-tensioned by elastic deformation of the spring element 2. The spring elements 2 comprise a protruding operating element, in particular a button that can be operated manually to operate the spring element 2. The spring elements 2 further comprise shoulders or bars which are designed to rest against the latching cams 11 in the assembled position in order to produce a positive locking and/or friction-locking connection.

In particular, the spring elements 2 snap into the latching recesses 10 behind the latching cams 11 when the fin 3 is attached to the base body 1. By compressing the spring elements 2 they can again be brought into a position, in which the spring elements 2 can be moved past the latching cams 11, whereby a separation of the fin 3 from the base body 1 is possible.

Figure 14:
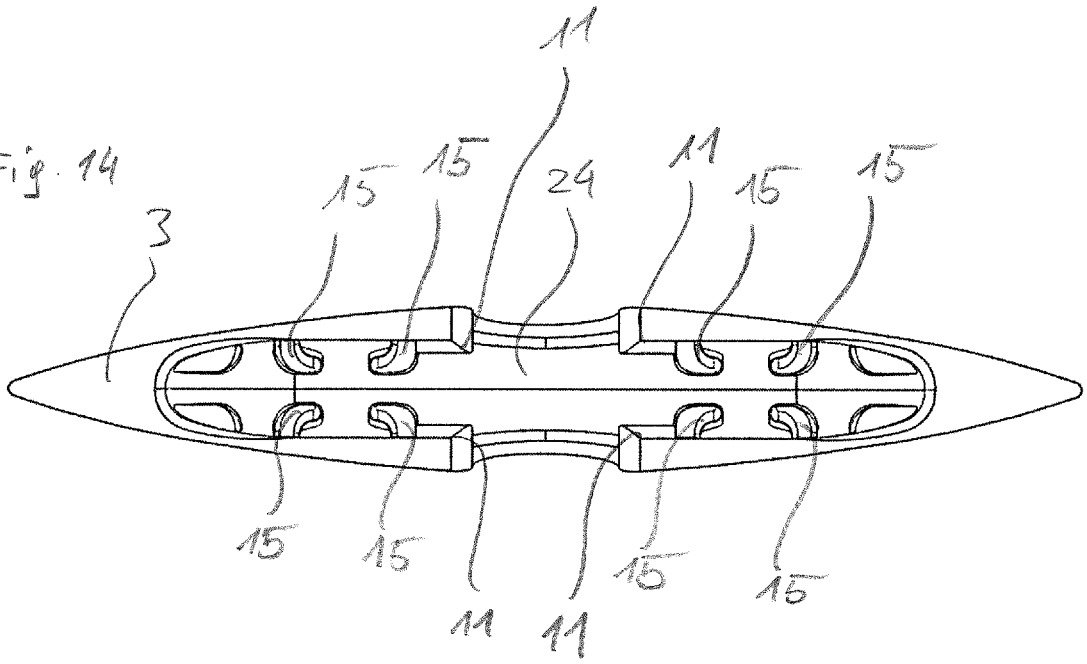
FIG. 14 shows a schematic view of the fin with the direction of view towards the recess.

FIG. 14 shows a view of a possible fin 3 of the embodiments of FIGS. 11, 12 and 13. The fin 3 comprises a recess 24 for receiving the base body 1. Within the recess 24 there are several longitudinal positive locking extensions 15 which run along the insertion direction. In the present embodiment, eight such longitudinal positive locking extensions 15 are provided. In addition, the fin 3, in the present embodiment, comprises four latching cams 11 which project from the side walls of the fin 3 into the recess 24, thus forming an undercut section, this undercut section being in particular the latching recess 10.

Figure 15:
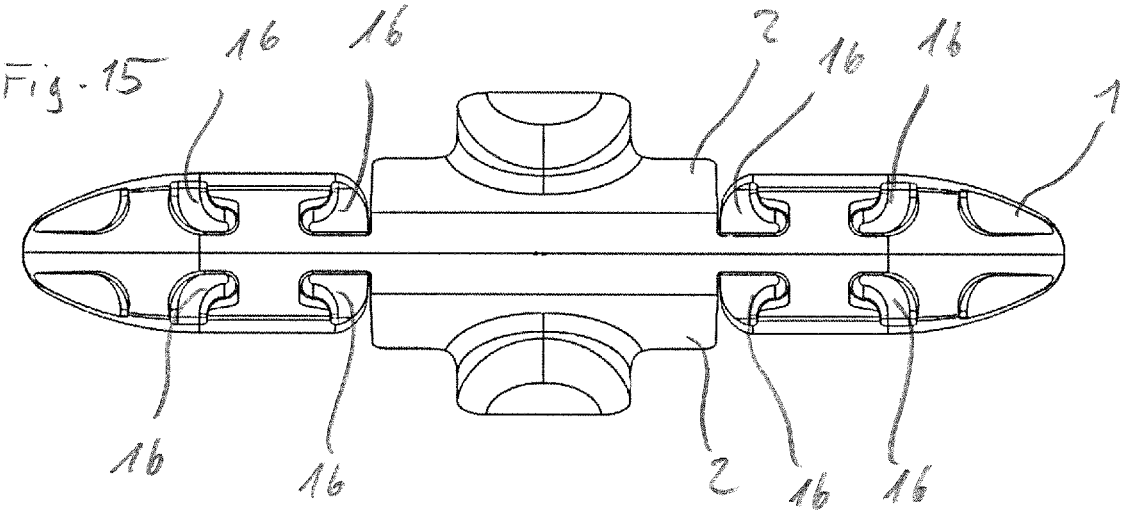
FIG. 15 shows a top view of a possible base body for the introduction into the recess of the fin of FIG. 14.

FIG. 15 shows a top view of a possible embodiment of a base body 1, for use with the embodiment of FIGS. 11, 12, 13 and 14. The base body 1 comprises two spring elements 2, which are protruding on both sides and are spring-mounted. The spring elements 2 each comprise two shoulders, which are set up for the contact and/or latching behind the latching cams 11. In addition, the base body 1 comprises several, in particular eight, longitudinal positive locking cutouts 16 to accommodate the longitudinal positive locking extensions 15 of the fin 3.

In the present embodiment, the longitudinal positive locking extensions 15 of the fin 3 serve in particular also to reinforce the fin 3, in particular to reinforce the fin 3 in the area of the recess 24 and to increase the stability of the fin arrangement transversely to the longitudinal direction of extension 13, in particular laterally. For this purpose, the longitudinal positive locking extensions 15 are formed, for example, bar-shaped and, in particular, arcuately bar-shaped. Furthermore, an increase in the stability of the fin arrangement is also achieved by the fact that the longitudinal positive locking cutouts 16 in the base body 1, and in particular also the base body 1 itself, fill the recess 24 at least in sections. The stability of the fin arrangement in the assembled position is improved by the resting of the inner surface of the recess 24 and the longitudinal positive locking extensions 15 against the base body 1. In particular, the longitudinal positive locking cutouts 16 are arched or undercut so that they can be filled by the longitudinal positive locking extensions 15, which are also arched. This creates a positive locking structure in which the longitudinal positive locking extensions 15 embrace elements surrounding the longitudinal positive locking cutouts 16. These elements are substantially arranged along the assembling direction of the fin 3. The cross section is preferably constant along this path.

In an alternative, not shown, embodiment, the latching cams 11 are not bar-shaped, as shown in FIGS. 11 to 15, but are formed as openings or recesses in the side wall, in particular in the inside of the side wall of the fin 3. Preferably, extensions are provided on the spring elements 2 which can be inserted into these openings in order to hook the fin 3 to the base body 1 and in particular to hook the spring elements 2 to these openings. The latching cams 11 in this design are therefore designed as openings, bores or similar recesses. The spring elements comprise extensions for latching in these openings, bores or recesses.

According to another, not shown, embodiment, a construction, as shown in FIGS. 11 to 15, comprises a hook pairing 6, as shown in FIGS. 1 to 10. For this purpose, in addition to the features of FIGS. 11 to 15, a hook pairing 6 with a hook groove 7 and a hook extension 8 must be provided so that a pivot axis 9 is formed. In addition, the fin 3 must preferably be provided with a pivot recess 19 to allow the fin 3 to pivot relative to the base body 1 about the pivot axis 9. In this embodiment, the longitudinal positive locking extensions 15 and the longitudinal positive locking cutouts 16 can be arched.

In the embodiments of FIGS. 11 to 15 and in the embodiments not shown, the base body 1 may each be constructed as a base body made in one piece from one material. The spring elements 2 of the base body 1 are therefore preferably a part of the base body 1. For example, the entire base body 1 including the spring elements 2 can be manufactured as a plastic part, for example as an injection-molded part.

It may be provided in the embodiments of FIGS. 11 to 15 and the embodiments not shown that the operating elements of the spring elements 2, which are in particular button-shaped, are substantially flush with the outside of the fin 3 in the connected position and in particular complete the shape of the fin 3. These operating elements may therefore form part of the fin surface.

The invention claimed is:

1. A fin arrangement for a water sports device, comprising:

a base body;

a fin which is detachably connected or connectable to the base body via at least one spring element without the use of tools, wherein the base body has a mounting surface that rests against the sliding surface of the main body of the water sports device, wherein the fin defines a recess that receives at least part of the base body, and wherein the fin also has an inner space into which the base body can be inserted in order to connect the fin with the base body; and at least one latching cam and at least one latching recess, wherein the at least one spring element in an assembled position is inserted into the at least one latching recess, wherein the spring element in the assembled position extends to the outside and/or is accessible from the outside, and wherein the spring element is manually compressible and thereby pre-tensionable to get past the latching cam when the fin is separated from the base body.

2. The fin arrangement according to claim 1, wherein the latching cam is arranged along the movement curve of the spring element when establishing the assembled position, and wherein in bringing the fin into its assembled position, the spring element is elastically deformed in such a way that the spring element can be inserted into the latching recess over the latching cam.

3. The fin arrangement according to claim 1, wherein the spring element in the assembled position is held in the latching recess in a force-locking or positively locking manner behind the latching cam.

4. The fin arrangement according to claim 2, wherein the spring element in the assembled position is held in the latching recess in a force-locking or positively locking manner behind the latching cam.

5. The fin arrangement according to claim 1, wherein the at least one spring element comprises two spring elements arranged on both sides of the longitudinal direction of extension and spring-mounted transversely to the longitudinal direction of extension, said two spring elements being arranged such that when the base is inserted into the recess of the fin, they lock automatically behind respective latching cams and can be released by pressing manually on both sides.

6. The fin arrangement according to claim 1, further comprising:

a longitudinal positive locking extension which insertable into a longitudinal positive locking cutout, the longitudinal positive locking extension being provided on either said base body or said fin and the longitudinal positive locking cutout being provided on the other of said base body and said fin, so that the longitudinal positive locking extension can be inserted into the longitudinal positive locking cutout by connecting the fin to the base body, and wherein the longitudinal positive locking extension introduced into the longitudinal positive locking cutout is configured to lock a degree of freedom which may act along the longitudinal direction of extension.

7. The fin arrangement according to claim 5, further comprising:

a longitudinal positive locking extension which insertable into a longitudinal positive locking cutout, the longitudinal positive locking extension being provided on either said base body or said fin and the longitudinal positive locking cutout being provided on the other of said base body and said fin, so that the longitudinal positive locking extension can be inserted into the longitudinal positive locking cutout by connecting the fin to the base body, and wherein the longitudinal positive locking extension introduced into the longitudinal positive locking cutout is configured to lock a degree of freedom which may act along the longitudinal direction of extension.

8. A water sports device comprising:

a main body having a sliding surface for moving on a water surface in a sliding manner; and a fin arrangement according to claim 1, wherein the mounting surface of the base body of the fin arrangement is arranged on the sliding surface of the main body of the water sports device.

9. A water sports device according to claim 8, wherein the base body protrudes from the main body or from the mounting surface or sliding surface of the water sports device along the normal direction of extension, and the base body is arranged completely outside of the main body of the water sports device and is uncovered with the exception of the mounting surface.

10. The water sports device according to claim 9, further comprising at least one fastening element that connects the base body to the main body, wherein each of the least one the fastening means is inserted into a fastening means opening to provide connection of the base body to the main body.

11. The water sports device according to claim 10, wherein said at least one fastening element comprises screws that are screwed through the main body into the fastening means openings of the base body.

12. The water sports device according to claim 8, wherein the water sports device comprises a solid main body with a wooden core or a solid plastic core.

13. The water sports device according to claim 8, further comprising at least one fastening element that connects the base body to the main body, wherein each fastening element is inserted into a fastening opening to provide connection of the base body to the main body.

14. The water sports device according to claim 13, wherein said at least one fastening element comprises screws that are screwed through the main body into the fastening openings of the base body, and wherein the water sports device comprises a solid main body with a wooden core or a solid plastic core.

15. A water sports device, comprising:

a main body having a sliding surface for moving on a water surface in a sliding manner; and a fin arrangement according to claim 7, wherein the mounting surface of the base body of the fin arrangement is arranged on the sliding surface of the main body of the water sports device.

16. A fin arrangement for a water sports device, comprising:

a base body; and a fin which is detachably connected or connectable to the base body via at least one spring element without the use of tools, wherein the base body has a mounting surface that rests against the sliding surface of the main body of the water sports device, wherein the fin defines a recess that receives at least part of the base body;

wherein the at least one spring element comprises two spring elements arranged on both sides of the longitudinal direction of extension and spring-mounted transversely to the longitudinal direction of extension, said two spring elements being arranged such that when the base is inserted into the recess of the fin, they lock automatically behind respective latching cams and can be released by pressing manually on both sides.

17. A water sports device comprising:

a main body having a sliding surface for moving on a water surface in a sliding manner; and a fin arrangement according to claim 16, wherein the mounting surface of the base body of the fin arrangement is arranged on the sliding surface of the main body of the water sports device.

18. A fin arrangement for a water sports device, comprising:

a base body; and a fin which is detachably connected or connectable to the base body via at least one spring element without the use of tools, wherein the base body has a mounting surface that rests against the sliding surface of the main body of the water sports device, wherein the fin defines a recess that receives at least part of the base body, and wherein the fin also has an inner space into which the base body can be inserted in order to connect the fin with the base body; and at least one latching cam and at least one latching recess, wherein the at least one spring element in an assembled position is inserted into the at least one latching recess, the fin arrangement further comprising: a longitudinal positive locking extension which insertable into a longitudinal positive locking cutout, the longitudinal positive locking extension being provided on either said base body or said fin and the longitudinal positive locking cutout being provided on the other of said base body and said fin, so that the longitudinal positive locking extension can be inserted into the longitudinal positive locking cutout by connecting the fin to the base body, and wherein the longitudinal positive locking extension introduced into the longitudinal positive locking cutout is configured to lock a degree of freedom which may act along the longitudinal direction of extension.

19. A water sports device comprising:

a main body having a sliding surface for moving on a water surface in a sliding manner; and a fin arrangement according to claim 18, wherein the mounting surface of the base body of the fin arrangement is arranged on the sliding surface of the main body of the water sports device.

* * * * *